US006468722B1

(12) United States Patent
Call et al.

(10) Patent No.: US 6,468,722 B1
(45) Date of Patent: Oct. 22, 2002

(54) PHOTOFINISHING PROCESSING SYSTEM AND A PROCESSING SOLUTION SUPPLY CARTRIDGE FOR THE PROCESSING SYSTEM

(75) Inventors: Robert B. Call, Rochester; Jay E. Mathewson, North Chili; Donna M. Timmons, Rochester; Richard R. Horn, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/822,963

(22) Filed: Mar. 30, 2001

(51) Int. Cl.[7] ..... G03C 5/44; G03C 7/42
(52) U.S. Cl. ..... 430/461
(58) Field of Search ..... 430/461

(56) References Cited

U.S. PATENT DOCUMENTS

| | | | | |
|---|---|---|---|---|
| 3,687,050 | A | 8/1972 | Wilke | 396/630 |
| 3,978,506 | A | 8/1976 | Geyken et al. | 354/324 |
| 4,171,716 | A | 10/1979 | Szabo et al. | 141/364 |
| 4,197,942 | A | 4/1980 | Gacki et al. | 206/219 |
| 4,791,013 | A | 12/1988 | Koboshi et al. | 428/35.3 |
| 4,814,809 | A | 3/1989 | DePrijcker et al. | 354/319 |
| 4,958,666 | A | 9/1990 | Kocourek et al. | 141/114 |
| 5,199,594 | A | 4/1993 | Obara et al. | 220/403 |
| 5,288,728 | A | 2/1994 | Spears et al. | 210/729 |
| 5,384,233 | A | 1/1995 | Kuse et al. | 430/461 |
| 5,398,093 | A | 3/1995 | Carozzi | 354/323 |
| 5,496,474 | A | 3/1996 | Christ, Jr. et al. | 210/725 |
| 5,503,751 | A | 4/1996 | Glover et al. | 210/765 |
| 5,526,087 | A | 6/1996 | Suzuki et al. | 354/324 |
| 5,532,780 | A | 7/1996 | Fyson | 354/324 |
| 5,561,488 | A | 10/1996 | Fyson | 396/578 |
| 5,577,614 | A | 11/1996 | Palmeroni, Jr. et al. | 206/521 |
| 5,675,792 | A | 10/1997 | Earle et al. | 396/626 |
| 5,690,817 | A | 11/1997 | Glover et al. | 210/138 |
| 5,694,991 | A | 12/1997 | Harris et al. | 141/346 |
| 5,720,383 | A | 2/1998 | Glover | 206/223 |
| 5,752,124 | A | 5/1998 | Glover et al. | 396/626 |
| 5,759,410 | A | 6/1998 | Christ, Jr. et al. | 210/711 |
| 5,778,272 | A | 7/1998 | Rosenburgh et al. | 396/564 |
| 5,778,274 | A | 7/1998 | Foster et al. | 396/636 |
| 5,882,593 | A | 3/1999 | Fyson | 422/40 |
| 5,996,653 | A | 12/1999 | Piccinino, Jr. | 141/346 |
| 6,040,776 | A | 3/2000 | Glover et al. | 340/618 |
| 6,058,954 | A | 5/2000 | Glover et al. | 137/1 |

FOREIGN PATENT DOCUMENTS

| | | |
|---|---|---|
| EP | 0 500 371 A2 | 2/1992 |

*Primary Examiner*—Hoa Van Le
(74) *Attorney, Agent, or Firm*—David A. Novais

(57) ABSTRACT

A cartridge that supplies fresh photographic processing solution or chemistry to a photoprocessing machine and recovers silver from spent processing solution. The cartridge is designed to integrate a solution supply system and a silver recovery system to facilitate the collection of silver from spent processing solution, form a less-regulated spent solution and reduce chemical exposures to operators of photoprocessing systems.

6 Claims, 6 Drawing Sheets

PHOTOFINISHING PROCESSING SYSTEM AND A PROCESSING SOLUTION SUPPLY CARTRIDGE FOR THE PROCESSING SYSTEM

CROSS REFERENCE TO RELATED APPLICATIONS

Reference is made to commonly assigned copending application Serial No. 09/823,076 filed Mar. 30, 2001, entitled A METHOD OF PROVIDING PHOTOPROCESSING SERVICES, filed concurrently herewith in the names of Loyd Lobo, Jeffery L. Hall, Robert Call, Jay Mathewson, Donna Timmons.

FIELD OF THE INVENTION

The present invention relates to a photofinishing processing solution supply cartridge, container or packaging system, as well as a processing system having a supply cartridge, container or packaging system that is adapted to hold processing solution and collect spent processing or cleaning solution. More particularly, the present invention relates to a chemical supply cartridge, container or packaging system having an integrated silver recovery process for photoprocessing systems.

BACKGROUND OF THE INVENTION

Current photographic processing machines are typically large, costly systems which are highly dependent on infrastructure, such as water supply and access to drain(s). The quantity of chemicals used in processing photographic materials has been historically high. Further, many processes rely on the use of concentrated chemistry and necessitate an additional source of water. As an added factor, almost all processors require significant infrastructure to support the treatment of spent solution and silver recovery.

There are a number of chemical delivery cartridges available that supply fresh photo-chemicals to photoprocessing machines. The machine operators who use the photochemicals are typically required by law to treat the effluent or spent processing solution from the process to reduce the level of aqueous silver before discharging the spent processing solution or effluent to municipal waste water treatment systems. These silver recovery treatment systems are typically sold as add-ons to the processors and require additional maintenance and operator intervention.

Current photographic processing machines are typically detached from the apparatus, method or mechanism of silver recovery. With the additional plumbing, solution transfer and operator intervention is required for an add-on mechanism. With the need for additional equipment and plumbing, inefficiencies in the overall processing system are created. Further, current photographic processing machines which have a detached silver recovery system positioned beside the processor define a larger overall footprint for the combined system and are higher in cost to maintain. There also remains a greater potential for failure of the silver recovery system and an increased likelihood for chemical exposure due to leaks and the additional plumbing that is needed to transport the solution from the processing machine to the detached silver recovery mechanism.

Further, in most current photoprocessing applications, concentrates are supplied to the customer who then dilutes them with water to significantly increase the volume subsequently requiring treatment. This is inconvenient or impractical in dispersed or less conventional market places such as retail stores, aircraft, and cruise ships since a water supply and plumbing is needed.

U.S. Pat. No. 4,791,013 discloses a housing pack for photographic processing solution. More specifically, U.S. Pat. No. 4,791,013 discloses a container having a first chamber for holding processing solution and a second chamber for collecting spent solution. However, in this patent the collected waste solution is only passed through a solution absorption substance to create a solid waste in which the amount of leachable silver in the spent solution is unchanged. U.S. Pat. No. 4,791,013 does not provide for a treatment of the spent solution in the supply cartridge in which the concentration of leachable silver in the spent solution is reduced with respect to the silver TCLP (Toxicity Characteristics Leaching Procedure) test for non-hazardous waste based on U.S. Resource Conservation and Recovery Act (RCRA) definitions so that the customer realizes waste management advantages. Advantages with this classification include reduced record keeping, training and cost.

U.S. Pat. No. 5,199,594 discloses a container having a flexible inner bag which is divided into a liquid storage chamber and a used-liquid storage chamber. However, like U.S. Pat. Nos. 4,791,013, 5,199,594 does not provide for a supply cartridge which both collects and renders spent solution RCRA non-hazardous which can be subsequently transported and treated with reduced regulatory control.

Federal Waste management regulations define the hazardous/non-hazardous characteristics of most photoprocessing solutions through the Toxicity Characteristics Leaching Procedure (TCLP) for silver. If a solution is negative in this test, it is not a format characteristic RCRA hazardous waste, which allows numerous handling exemptions such as the ability to transport the solution by a non-hazardous hauler without excessive paperwork. Within the context of the present invention, leachable silver is defined as the analysis of the amount of silver that will leach from a solid or the amount of silver that is present in a liquid. The leaching test is used to determine if the material is a hazardous waste by using the Toxicity Characteristic Leaching Procedure (TCLP) (EPA Test Method 1311). Solids are reduced in size and subjected to a dilute acid solution. The leachate is then analyzed to determine the amount of silver extracted from the solid. Liquids are directly analyzed for total recoverable silver.

There is presently a need for the improvement of the chemical supply system so that photoprocessing machines can utilize a silver recovery technique with a chemical supply cartridge without the need for a separate or detached silver recovery device. That is, there is presently a need for a chemical supply cartridge or container that can be retrofitted to an existing processor or can be fluidly connected to a new or stand-alone processor, which is adapted to supply processing solution to the processor, as well as collect and treat spent solution for the purpose of reducing TCLP leachable silver in the spent solution.

SUMMARY OF THE INVENTION

Recent advancements in the minimization of solution usage in photoprocessing has made delivering and removing of working strength photographic chemistry economically viable. The present invention provides for a chemical management cartridge that both delivers fresh chemistry and receives, accumulates and renders spent effluent in a manner which permits the spent effluent to be disposed of in a less-regulated manner. Within the context of the present invention, spent or waste solution or effluent refers to processing solution which has gone through a photoprocessing cycle and is no longer resident in the processor (or processing equipment). For a stand-alone or new processor, the integration of the spent solution management with the chemical supply delivery system gives the practical advantage of permitting a processing of photographic materials without direct connections to a water supply or drain. It also enables a single service organization to both deliver supply solutions and remove spent solutions. For an existing processor, the cartridge of the present invention can be retrofitted to the processor, be adapted to deliver processing solution to the processor, and used to collect and treat spent solution from the processor. If the existing processor includes the necessary plumbing, the cartridge of the present invention can be adapted to reduce leachable silver in the spent solution and deliver the spent solution to an existing plumbing system without requiring special handling.

A preferred embodiment of the present invention utilizes the ability to deliver working strength chemistry (i.e. for use in a minilab where "solution volume in" equals "collected solution volume" for de-silvering), thereby eliminating dilution errors during operation. A secondary advantage is an improvement in portability and the reduction of the "footprint" of the processor that allows processing of film to occur in less conventional market places, including mobile locations such as an aircraft or cruise ships. By leveraging these advantages, placement of the photoprocessor machines in dispersed or less traditional retail locations is permitted.

The system of the present invention also enables an apparently dry operation, where contact with the processing chemicals is minimized and the operator has limited opportunity for chemical exposure. This is beneficial in non-traditional photofinishing locations where there is a preference towards a semi-hands free operation where the supply and spent solutions need to be invisible to the users and customers of the users. The reuse of an external cartridge shell provides for an efficient use of materials, which offers an environmental benefit along with potential cost savings.

Therefore, the present invention integrates the collection of waste solution and the minimization of leachable silver from the spent solution within a photoprocessing solution supply system. The advantage of the present invention over conventional approaches is that it provides for a convenient method and system for silver recovery with minimal operator interaction with the equipment. Further, it facilitates the creation of a spent or waste solution that is less regulated for transport and disposal. Furthermore, it reduces chemical exposure for the operator and reduces the chances of error with respect to silver recovery. The invention also reduces the floor space required for the processor due to the fact that the silver recovery system is integrated with the processor rather than being attached separately.

The present invention accordingly provides for a photofinishing processing solution supply cartridge which is adapted to hold processing solution therein, and collect spent or waste processing solution and leachable silver in the collected spent processing solution. In the method and system of the present invention, an apparatus can be used as a chemical supply delivery system for processing photosensitive media, and for removing or reducing the amount of leachable silver in the spent processing solution. In a preferred embodiment, the invention can be utilized in photoprocessing machines that use a cartridge-style processing solution or chemical supply system. Thus, the cartridge of the invention could be designed to be used within a system in which a single entity delivers fresh chemistry and collects the recoverable silver for recovery or treatment, as opposed to providing two distinct entities to effect these operations or services. In a further embodiment, the cartridge can be retrofitted into an existing processor and the treated spent solution can be supplied in a less-regulated manner to an existing plumbing system.

The present invention therefore relates to a photofinishing processing solution supply cartridge that comprises at least one processing solution chamber or vessel for holding processing solution therein; and at least one spent or waste solution chamber or vessel that is adapted to collect spent or waste solution from a photofinishing system associated with the supply cartridge. The at least one spent or waste solution chamber comprises a silver removal device that reduces an amount of leachable silver contained in the spent solution.

The present invention further relates to a photofinishing processing solution supply cartridge that comprises at least one processing solution chamber for holding processing solution therein, and at least one spent solution chamber or vessel that is adapted to collect spent solution from a photofinishing system associated with the supply cartridge. The at least one spent solution vessel or chamber provides a silver precipitating agent. The silver precipitating agent is adapted to react with the spent solution in the vessel or chamber to form a removable silver sludge in the vessel or chamber.

The present invention further relates to a photofinishing processing solution supply cartridge which comprises at least one processing solution chamber for holding processing solution therein and supplying processing solution to a photofinishing system which is fluidly associated with the supply cartridge; and a silver removal device for removing silver from spent processing solution of the photofinishing system associated with the supply cartridge to provide a spent solution that is substantially free of leachable silver.

The present invention further relates to a processing system comprising a processor for processing photosensitive media therein; and a processing solution supply cartridge adapted to supply processing solution to the processor and collect spent processing solution from the processor. The processing solution supply cartridge has at least one chamber for holding the processing solution therein and a silver removal device for reducing an amount of leachable silver in the spent processing solution, to provide a spent solution that is substantially free of leachable silver.

The present invention further relates to a processing system that comprises a processor for processing photosensitive media therein; and a processing solution supply cartridge that is adapted to supply processing solution to the processor and collect spent processing solution from the processor. The processing solution supply cartridge comprises at least one processing solution chamber or vessel for holding processing solution therein; and at least one spent solution chamber or vessel for collecting spent processing solution from the processor. The at least one spent solution chamber or vessel comprises a silver removal device that reduces an amount of leachable silver contained in the spent solution to provide a spent solution substantially free of leachable silver.

The present invention further relates to a processing system that comprises a processor for processing photosensitive media therein; and a processing solution supply cartridge that is adapted to supply processing solution to the processor and collect spent processing solution from the processor. The processing solution supply cartridge comprises at least one processing solution chamber, vessel or area that holds processing solution therein, and at least one spent solution vessel, chamber or area that is adapted to collect the spent solution from the processor. The at least one spent solution vessel, chamber or area comprises a silver precipitating agent. The silver precipitating agent is adapted to react with the spent solution in the vessel, chamber or area to form a removable silver sludge in the vessel.

The present invention further relates to a method of removing silver from photofinishing processing solution which comprises the steps of feeding spent processing solution from a photofinishing system to a supply cartridge, with the supply cartridge having incorporated therein at least one chamber for holding fresh processing solution and at least one further chamber adapted to collect the spent processing solution; and reducing an amount of leachable silver in the spent processing solution collected in the at least one further chamber.

The present invention further relates to a method of processing photosensitive media which comprises the steps of supplying processing solution from a supply cartridge to a processor for processing a photosensitive media in the processor, with the supply cartridge having a first area for holding fresh processing solution; feeding spent processing solution from the processor to a second area of the supply cartridge; and reducing an amount of leachable silver in the spent processing solution in the second area of the supply cartridge.

The present invention further relates to a container for photographic processing solution. The container comprises a rigid and reusable outer shell which is adapted to be opened to access an interior of the shell; and at least two internal chambers positioned in the interior of the shell and accessible when the outer shell is opened. A first chamber of the at least two internal chambers is adapted to supply fresh working strength photochemistry, a concentrated mixture of chemistry or cleaning solution to a processing machine which is operationally associated with the container; and a second chamber of the at least two internal chambers is adapted to collect spent processing solution or cleaning solution from the processing machine and reduce an amount of silver in the spent processing solution or cleaning solution.

The present invention further relates to a solution container for a photoprocessing machine which is adapted to supply water, a mixture of concentrated processing solution, and/or working strength processing solution to the photoprocessing machine, and collect and treat spent solution from the photoprocessing machine. The container comprises a rigid and reusable outer shell.

The present invention further relates to a method of processing photographic media which comprises the steps of fluidly connecting a container to a photoprocessing machine, with the container comprising a rigid and reusable outer shell that is adapted to hold processing solution and collect spent solution; supplying processing solution from the container to the photoprocessing machine; collecting spent solution from the photoprocessing machine in the container; and treating the spent solution to create a spent solution which is substantially free of leachable silver.

The present invention further relates to a method of supplying photographic processing solution to a processor which comprises the steps of: placing a processing solution supply cartridge having processing solution therein on a movable fixture member in a manner in which a valve of the supply cartridge and the supply cartridge are in an upright position; and moving the fixture member having the supply cartridge thereon to an operating position in which the supply cartridge is placed in an inverted position to permit a supply of processing solution through the valve from the supply cartridge to a processor which is fluidly connected to the supply cartridge.

DETAILED DESCRIPTION OF THE INVENTION

Figure 1:
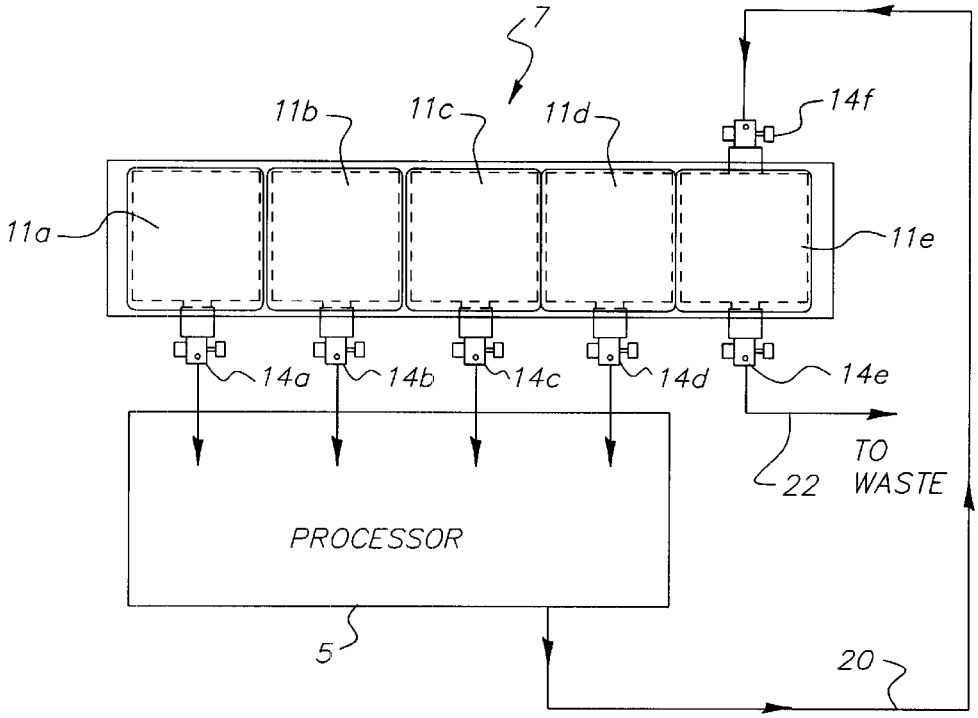
FIG. 1 schematically illustrates a processing system including a processor and a supply cartridge in accordance with the present invention.

Referring now to the drawings, wherein like reference numerals represent identical or corresponding parts throughout the several views, a processor 5 is schematically shown in FIG. 1. Processor 5 can be a known processor having individual processing tanks, areas or sections, and a photosensitive media path which passes through the appropriate sections for processing photosensitive media in a known manner. Processor 5 is further adapted to receive fresh processing solution from a supply cartridge, or container or packaging system 7. More specifically, as is illustrated in FIG. 1, and using cartridge 7 of FIGS. 1 and 2 as an example, processor 5 is adapted to be operationally or fluidly connected with processing solution or chemical supply cartridge or container 7. With regard to the details of chemical supply cartridge or container 7, reference is made to FIG. 2.

Figure 2:
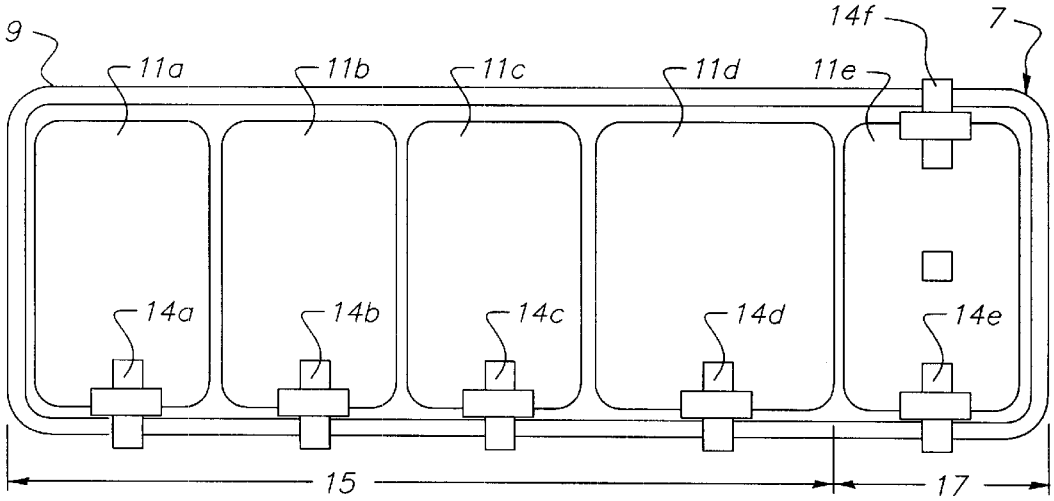
FIG. 2 schematically illustrates one embodiment of a supply cartridge utilized in the processing system of FIG. 1.

As illustrated in FIG. 2, chemical supply cartridge 7 can include a rigid and reusable outer shell 9 that can be opened to gain access to or facilitate the removal of internal chambers, vessels, containers or areas 11*a*, 11*b*, 11*c*, 11*d* and 11*e*. Rigid shell 9 can be made of a combination of materials including but not limited to LLDPE (linear low density polyethylene), nylon, EVOH (Ethylene vinyl Alcohol), (Saran PVDC Polyvinlyadene Chloride) or HDPE (High density polyethylene). In a preferred embodiment outer shell 9 can be either a corrugated fiber board, HDPE or polypropylene.

As is also shown in FIG. 2, chemical supply cartridge 7 includes valves 14*a*, 14*b*, 14*c*, 14*d*, 14*e* and 14*f* which can be either internal or external to rigid outer shell 9 and can be quick release valves or release fittings for fluidly connecting the cartridge to the processor in a known manner. Valves 14*a*–14*d* are respectively associated with chambers 11*a*–11*d*, while valves 14*e*–14*f* are associated with chamber 11*e*.

As an example, chamber or vessel 11*a* can hold and/or supply developer to processor 5; chamber or vessel 11*b* can hold and/or supply fresh ferrous/ferric solution to processor 5; chamber or vessel 11*c* can hold and/or supply fixer solution to processor 5; and chamber or vessel 11*d* can hold and/or supply a final rinse or cleaning solution to processor 5. Chambers 11*a*–11*d* are provided in an area 15 of cartridge 7 that can be generally defined as a processing solution holding and/or supplying area. Depending on where the cartridge is to be used (i.e. retrofitted to an existing processor or minilab, or attached to a new processor or minilab) chambers 11*a*–11*d* can hold fresh working strength photochemistry therein, a mixture of concentrated chemistry and/or cleaning solution such as water. In a preferred embodiment, chambers 11*a*–11*d* hold working strength chemistry in a manner in which "solution volume in" equals "collected solution volume".

Cartridge 7 further includes chamber or vessel 11*e* which is a silver removal device or mechanism. Unlike fresh processing solution chambers 11*a*–11*d*, vessel 11*e* includes valve or release fitting 14*e* for discharge of a reduced leachable silver spent or waste processing solution, and valve 14*f* which is adapted to receive spent or waste processing solution from processor 5 for treatment. Silver removal chamber 11*e* is provided in an area 17 of cartridge 7 which can generally be defined as a spent solution collection and leachable silver removal area.

Thus, supply cartridge 7 essentially defines a first area 15 which is adapted to hold fresh processing solution, and a second area 17 which is adapted to collect spent or waste processing solution or used cleaning solution, and by a selected treatment, reduce the amount of leachable silver from the spent processing solution or the used cleaning solution in a manner which will be described later.

It is noted that the number of supply chambers and spent solution chambers is not limited to the number shown in FIG. 1. It is recognized that the number of supply chambers and spent solution chambers utilized is based on design considerations and the type of processing cycle desired.

With reference to FIG. 1, cartridge 7 supplies fresh photographic processing solution or chemistry (working strength or concentrated mixture depending on the type of processing and the processor) to processor or photoprocessing machine 5, and recovers, reduces or removes leachable silver from the spent or waste processing or cleaning solution. This is achieved by an integration of a solution supply system in the form of supply cartridge 7 with a method of silver recovery of photographic processing solution for a film or paper processor. Thus, during use of a photofinishing system as schematically shown in FIG. 1, media is supplied to processor 5 and processed in a known manner. During processing, selected fresh processing solution, chemicals or cleaning solution are selectively supplied from chambers 11*a*–11*d* via valves 14*a*–14*d*. After processing, spent processing solution or cleaning solution is circulated via, for example, a spent processing solution conduit or line 20 to valve 14*f* of chamber 11*e*.

In a preferred embodiment, chamber 11*e* would house or be in the form of a "silver removal device". The silver removal device could utilize one of several known silver recovery techniques such as but not limited to metallic replacement technologies, ion exchange resin or TMT (see, for example, U.S. Pat. Nos. 5,288,728; 5,496,474 and 5,759,410). The use of a silver removal device permits the spent processing solution to pass through the device and after a fixed time period the silver contained in the spent processing solution is collected within the trapping matrix contained in the silver removal device. Substantially, leachable silver-free spent processing solution or cleaning solution is then passed via valve 14*e* and a discharge line 22 to a sewer in a less regulated manner, or can be collected as a less-regulated waste based on U.S. RCRA limits for leachable silver.

Within the context of the present invention, a substantially leachable silver-free spent solution refers to the fact that the spent solution can be disposed of or handled in a less-regulated manner per U.S. RCRA legislation. As an example, the combined waste effluent of a typical minilab contains 3500 ppm of silver. With a supply cartridge in accordance with the present invention having an integrated silver removal device as described above, the amount of silver in the spent solution is recovered, removed, or reduced to create a substantially leachable silver-free spent solution at or below 5 ppm of silver, which is presently the U.S. Federal Standard 40 CFR 241.24(*a*).

In the event cartridge 7 is retrofitted or attached onto an existing processor or processing machine, it is likely that plumbing leading toward a sewer system exists. In that case, cartridge 7 of the present invention can be attached to a discharge line 22 (FIG. 1) to pass the substantially leachable silver-free spent solution to the sewer line or the like as regulations permit. Of course, the present invention is not limited thereto, and as will be described later, other treatment and disposal methods depending on whether you retrofit the cartridge to an existing processor or use a stand-alone processor are possible. In either case, however, the present invention provides for a convenient cartridge which supplies processing solution to a processor, collects spent solution, and creates less-regulated waste based on present U.S. Federal Standards 40 CFR 241.24(*a*).

When supply chambers 11*a*–11*d* are empty, chamber 11*e* or the "silver removal device" within chamber 11*e* may be detached or removed from cartridge 7 and sent to a refiner to enable a cost effective shipment and recovery of the silver. As an alternative, the entire cartridge 7 can be detached or removed from processor 5 and shipped to the refiner. It is, however, recognized that the removal of the silver removal device, chamber 11*e* or cartridge 7 can be done at other times which are convenient to the photofinisher.

As an alternative embodiment, the silver-bearing spent processing solution can be supplied via line 20 to chamber 11*e* in the same manner as the embodiment discussed above, and chamber 11*e* can include a silver precipitating agent or silver recovery agent instead of a "silver removal device". The agent would be allowed to react with the aqueous silver in chamber 11*e* to create a silver-sludge which can be later separated for the silver content by an outside service provider or machine operator and can be disposed of and transported as less-regulated waste.

More specifically, the solution can be stored within chamber 11*e* having a silver recovery agent such as steel wool, TMT, ion exchange material and/or resin, etc. The silver recovery agent can also be, but is not limited to, a compound that can form a sparingly soluble salt of silver ion, such as iodide, organic thiols, TMT, etc. In this alternative embodiment, discharge line 22 and valve 14*e* would not be required. Such an embodiment would be preferably used on a stand-alone processor such as a mini-lab in a retail store, where appropriate plumbing and sewer lines do not exist.

As noted above, in the present invention, supply cartridge 7 is comprised of at least one internal chamber or vessel 11*a*–11*d* of processing solution and at least one internal chamber or vessel 11*e* for the collection of silver from the spent processing solution. As also described above, in a preferred embodiment, chamber 11*e* would include or define a silver removal device or mechanism. This silver removal device could utilize one of several known recovery techniques noted above, such as but not limited to metallic replacement technologies, ion exchange material and/or resin or TMT. The silver removal device provided in, incorporated into or formed by chamber 11*e* would permit the spent processing solution or effluent to pass through it and after a fixed time period, the silver contained in the waste processing solution is collected within, for example, a trapping matrix contained in the silver removal device. Substantially leachable silver-free spent processing solution is then passed to a sewer or can be collected as less-regulated waste based on current U.S. Government Standards.

The present invention therefore provides for an improved and convenient photoprocessing system that includes a silver recovery system within a processing solution or chemical delivery cartridge. With the silver recovery process coupled with solution supply, the maintenance of the silver recovery becomes easier for the customer.

Figure 3:
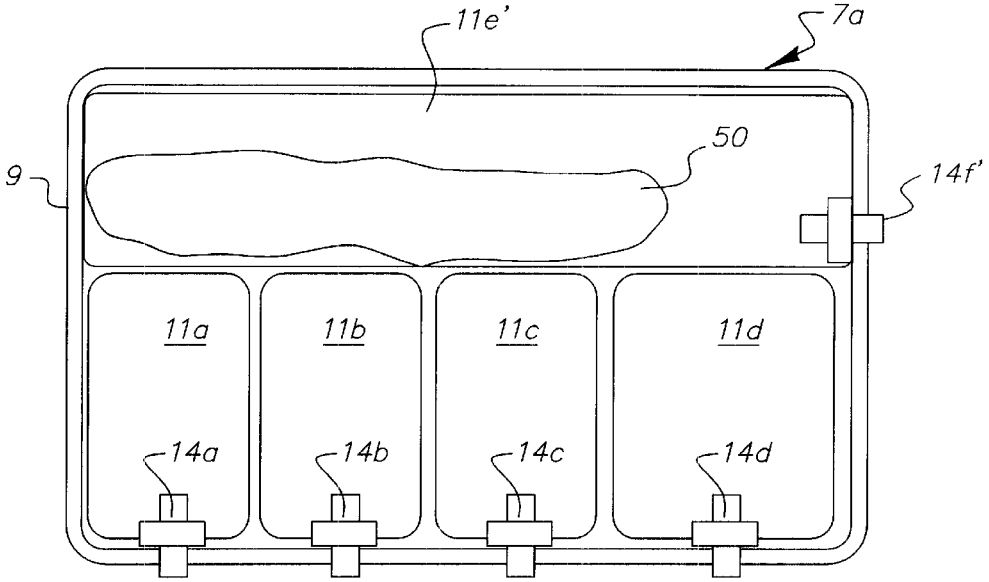
FIG. 3 schematically illustrates a further embodiment of a supply cartridge in accordance with the present invention.

Referring now to FIG. 3, a further embodiment of a supply cartridge in accordance with the present invention is shown. More specifically, FIG. 3 illustrates supply cartridge 7*a* which includes rigid outer shell 9 similar to the shell illustrated in FIG. 2. As previously described, shell 9 can be opened to gain access to or facilitate the removal of internal chambers.

Further, like supply cartridge 7 of FIG. 2, supply cartridge 7*a* of FIG. 3 includes internal supply chamber 11*a* with valve 14*a* which can house and/or supply, for example, developer solution; internal supply chamber 11*b* with valve 14*b* which can house and/or supply, for example, ferrous/ferric solutions; internal supply chamber 11*c* with valve 14*c* which can house and/or supply, for example, fixer solution, and internal supply chamber 11*d* with valve 14*d* which can house and/or supply, for example, a final rinse or cleaning solution.

One difference between cartridge 7 of FIG. 2 and cartridge 7*a* of FIG. 3 relates to the positioning of spent solution chamber 11*e*. In the embodiment of FIG. 3, a spent solution chamber 11*e*' which extends over each of supply chambers 11*a*–11*d* is shown. In cartridge 7*a* as shown in FIG. 3, the silver removal system is in the form of a silver precipitating agent 50 within chamber 11*e*'. In the case of using a silver precipitating reagent, chamber 11*e*' would include a valve 14*f*' which receives spent processing solution from processor 5 as described in FIG. 1, but would not require a discharge line or discharge valve. With the use of this embodiment and as described above, the silver precipitating agent reacts with the spent processing solution so as to provide for a silver sludge that can be removed from the supply cartridge in a less-regulated manner. This embodiment is most preferably used on a stand-alone processor where working strength chemistry is used and which is located in an area that may not have appropriate on-site plumbing and/or sewer facilities.

Therefore, in the same manner as described with respect to the embodiment of FIG. 2, cartridge 7*a* of FIG. 3 is a cartridge that can be used to supply and remove all photoprocessing chemicals from a photoprocessing machine such as processor 5 of FIG. 1. Also in the same manner as the embodiment of FIG. 2, cartridge 7*a* can be comprised of a rigid external shell that encloses at least one internal chamber (in FIG. 3 internal chambers 11*a*–11*d* are shown) of supply solution, and at least one internal chamber 11*e*' for the collection of spent solution. Chambers 11*a*–11*d* as well as chamber 11*e*' may be removable to enable refilling with fresh solutions and reuse of the cartridge.

In a preferred feature of FIGS. 2 and 3, chambers 11*a*–11*d*, 11*e* and 11*e*' may be made of flexible material(s) including but not limited to LLDPE (linear low density polyethylene), nylon, EVOH (Ethylene vinyl Alcohol), (saron PVDC Polyvinlyadene Chloride) or HDPE (High density polyethylene), and can be located in adjacent physical positions to allow for displacement of volume as the supply chambers 11*a*–11*d* empty and the spent solution chamber 11*e* or 11*e*' fill with chemical solutions during a photofinishing operation as described with reference to FIG. 1.

In an alternative feature, chambers 11*a*–11*d*, 11*e* and 11*e*' may be made of rigid materials. As a still further feature, the chambers or vessels described above may include either working strength or concentrated photoprocessing chemistries depending on whether the cartridge is to be retrofitted onto an existing processing machine or if the cartridge is to be attached to a stand-alone type processor.

Figure 4A:
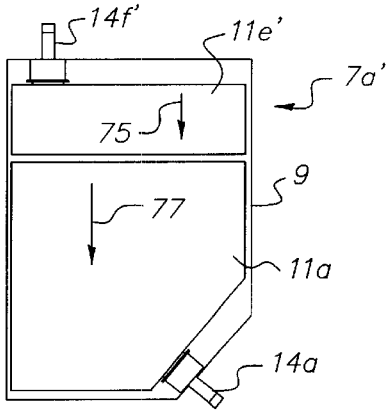
FIGS. 4A–4B respectively illustrate an end view and a side view of a still further embodiment of the supply cartridge of the present invention.
Figure 4B:
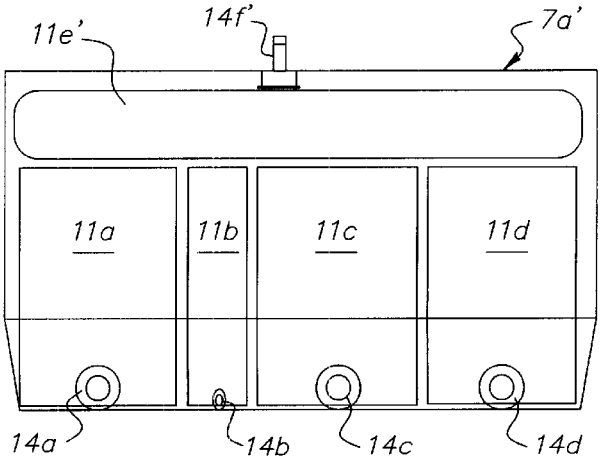

FIGS. 4A–4B, 5 and 6A–6C illustrate further embodiments of supply cartridges in accordance with the present invention. Referring first to FIGS. 4A–4B, this embodiment is similar to cartridge 7*a* illustrated in FIG. 3, but shows further details on the design of outer shell 9 of the supply cartridge. More specifically, and referring first to FIG. 4A, a side view of supply cartridge 7*a*' is shown. As illustrated, shell 9 can include a slanted end 9*a* to facilitate cooperation and attachment with a processor. Within rigid outer shell 9 internal chambers are located. In the view of FIG. 4A, supply chamber 11*a* and spent solution chamber 11*e*' are shown. In one embodiment, both spent solution chamber 11*e*' and chambers 11*a*–11*d* can be made of a collapsible and/or flexible material. Therefore, as spent solution fills spent solution chamber 11*e*' via valve 14*f*, chamber 11*e*' will expand in the direction of fill as illustrated by arrow 75. As spent solution chamber 11*e*' fills, supply solution chamber 11*a*, as well as the remaining supply solution chambers 11*b*, 11*c* and 11*d* as illustrated in FIG. 4B, will collapse in the direction shown by arrow 77 (FIG. 4A). This more easily facilitates the supply of processing solution via valves 14*a*, 14*b*, 14*c* and 14*d* to a processor (FIG. 1), as well as assures that each of chambers 11*a*–11*d* completely empty since solution will be forced out of chambers 11*a*–11*d* due to the expansion and increased weight of the filling chamber 11*e*'.

Depending on the type of spent solution treatment desired, once spent chamber 11*e*' is filled and solution chambers 11*a*–11*d* are emptied, waste solution chamber 11*e*' can be discarded or recycled using any of the procedures already described. For example, in a stand-alone processing unit, a precipitating agent as illustrated in, for example, FIG. 3, can be inserted in chamber 11*e*'. This would provide for a silver sludge that can be removed in a less-regulated manner. As a further option, if cartridge 7*a*' is provided on an existing processor having an existing on-site plumbing system, chamber 11*e*' can include a silver removal device as previously described, such as for example, an ion exchange material, to provide a substantially leachable silver-free spent solution. In this way, the substantially leachable silver-free spent solution can be discharged from spent chamber 11*e*' via a second valve to an existing sewer line in a less-regulated manner (see, for example, FIG. 1).

In a further feature of cartridge 7*a*' illustrated in FIG. 4B, supply chambers 11*a*–11*d* can be different in size depending on the type of processing solution being supplied. For example, supply chamber 11*b* can be smaller in volume than the remaining supply chambers if less solution of the type supplied by chamber 11*b* is necessary.

Figure 5:
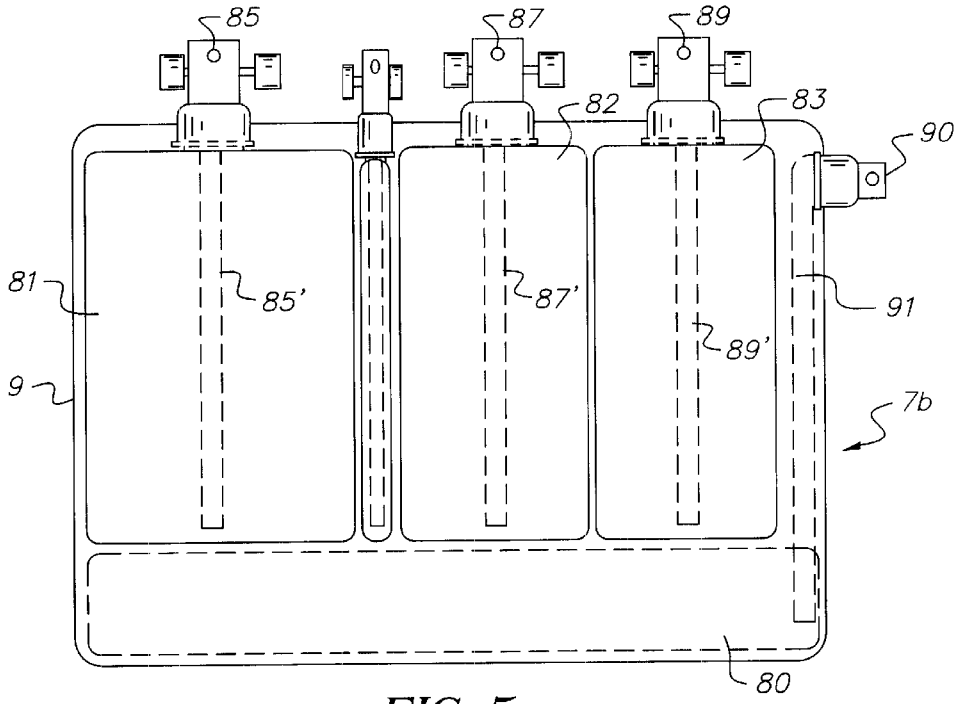
FIG. 5 illustrates a still further embodiment of a supply cartridge of the present invention.

FIG. 5 illustrates a further embodiment of a supply cartridge in accordance with the present invention. In the embodiment of FIG. 5, supply cartridge 7*b* is designed such that the spent solution chamber is provided at the lower end or bottom of shell 9 as opposed to the top of the shell as illustrated in FIGS. 3, 4A–4B.

Therefore, as illustrated in FIG. 5, a spent solution chamber 80 is positioned at the bottom of outer shell 9. Processing solution supply chambers 81, 82 and 83 which deliver processing solution to an associated processor (FIG. 1) are positioned over spent solution chamber 80 in the manner illustrated in FIG. 5. Each of supply chambers 81, 82 and 83 respectively include a valve 85, 87 and 89 which operate as previously described with respect to the other embodiments and are located on the top of shell 9. In the embodiment illustrated in FIG. 5, cartridge 7*b* can be attached to a processor in a manner which permits processing solution to be supplied by way of, for example, suction tubes 85', 87' and 89' and via valves 85, 87 and 89 to the processor. Spent solution is delivered via, for example, valve 90 located on the side of shell 9 and suction tube 91 to spent solution chamber 80, and is treated as described previously with respect to the other embodiments. More specifically, spent solution collected in spent solution chamber 80 can be treated using any of the previously described techniques to form or provide a substantially leachable silver-free spent or waste solution that can be disposed of in a less-regulated manner. In the event that all the chambers are flexible, as spent solution chamber 80 fills, it upwardly extends while collapsing chambers 81, 82 and 83. Supply cartridge 7*b* operates in the same manner as described with respect to the previous embodiments and can be used with new processors or retrofitted to existing processors.

Figure 6A:
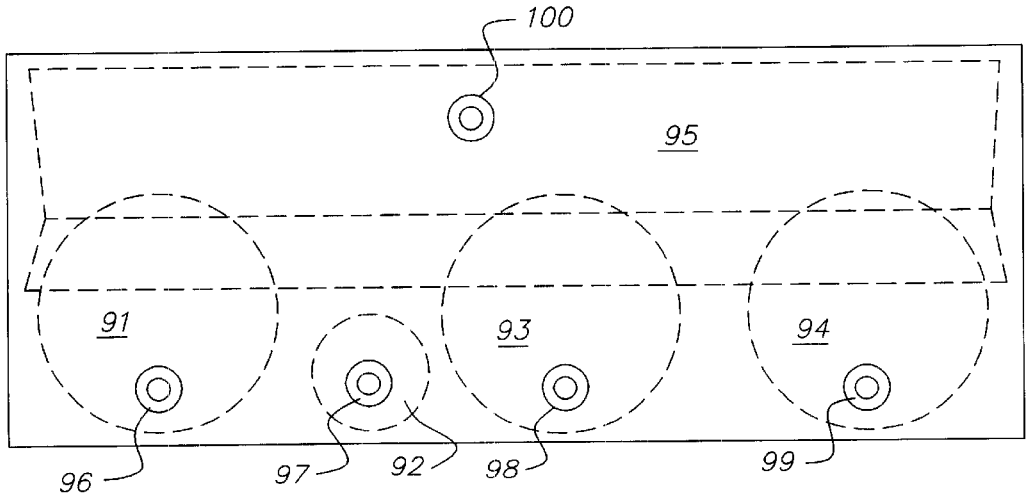
FIGS. 6A–6C respectively illustrate a top view, a side view and an end view of a still further embodiment of the cartridge of the present invention.
Figure 6B:
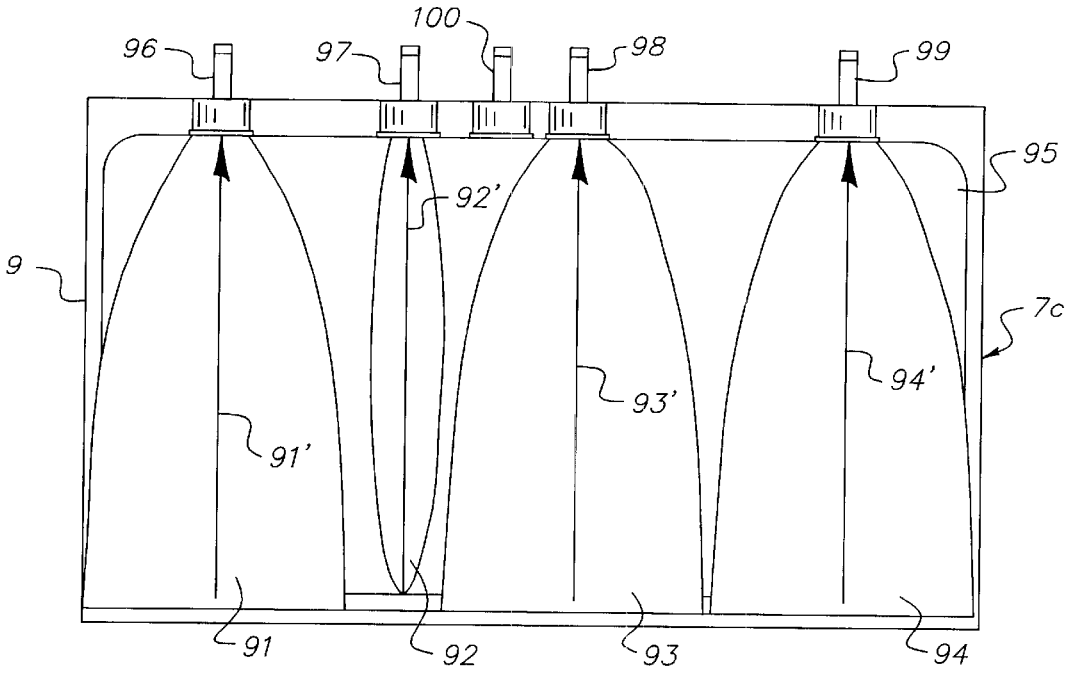
Figure 6C:
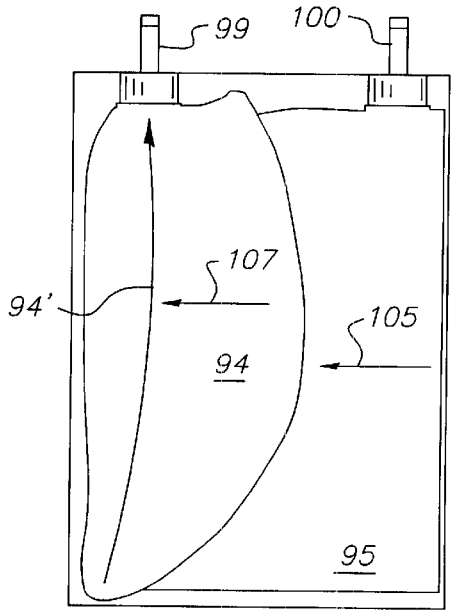

FIGS. 6A–6C illustrate a further embodiment of a supply cartridge in accordance with the present invention. More specifically, FIGS. 6A–6C respectively illustrate a top view, a side view and an end view of a supply cartridge 7*d*. In the embodiment of FIGS. 6A–6C, the spent solution chamber is placed in a side-by-side adjacent relationship to the supply chambers.

More specifically, as shown in FIGS. 6A–6C, cartridge 7*d* includes shell 9 that has positioned therein supply chambers 91, 92, 93 and 94 for holding and delivering processing solution such as developer, bleach, fixer, wash, etc. Cartridge 7*d* further includes a spent solution chamber 95 positioned adjacent to each of supply chambers 91, 92, 93 and 94. As also shown, each of chambers 91, 92, 93 and 94 respectively include a suction tube 91', 92', 93' and 94' for supplying processing solution to respective valves 96, 97, 98 and 99. In the same manner as previously described with respect to the other embodiments, cartridge 7*d* can be attached to a processor. Also, chamber 95 includes a valve 100 for receiving spent solution from the processor in a manner which has also been described.

In a feature of the embodiment of FIGS. 6A–6C, the chambers are flexible and/or collapsible, therefore, as spent solution chamber 95 fills it will expand as shown by arrow 105 in FIG. 6C. As spent solution chamber 95 expands, supply chambers 91, 92, 93 and 94 will collapse in the direction illustrated by arrow 107 (FIG. 6C) as they supply solution to the processor.

Operation of the embodiment of FIGS. 6A–6C with respect to attachment to an associated processor, supplying processing solution to the associated processor, receiving spent solution, and disposing of the spent solution is similar to the previously described embodiments.

Figure 7A:
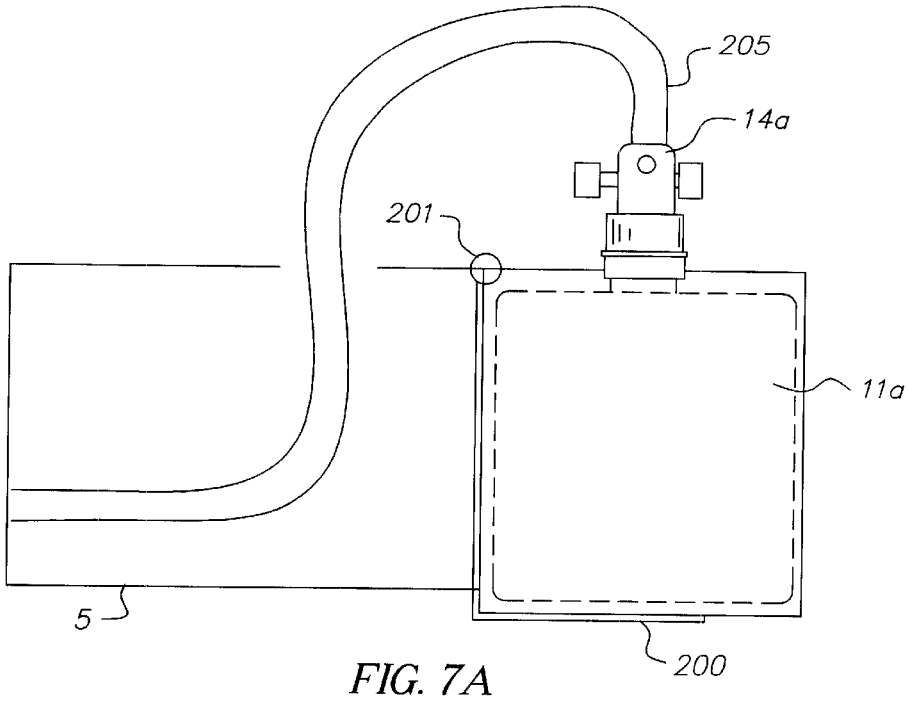
FIGS. 7A–7B illustrate an example of an attachment feature for a supply cartridge in accordance with the present invention.
Figure 7B:
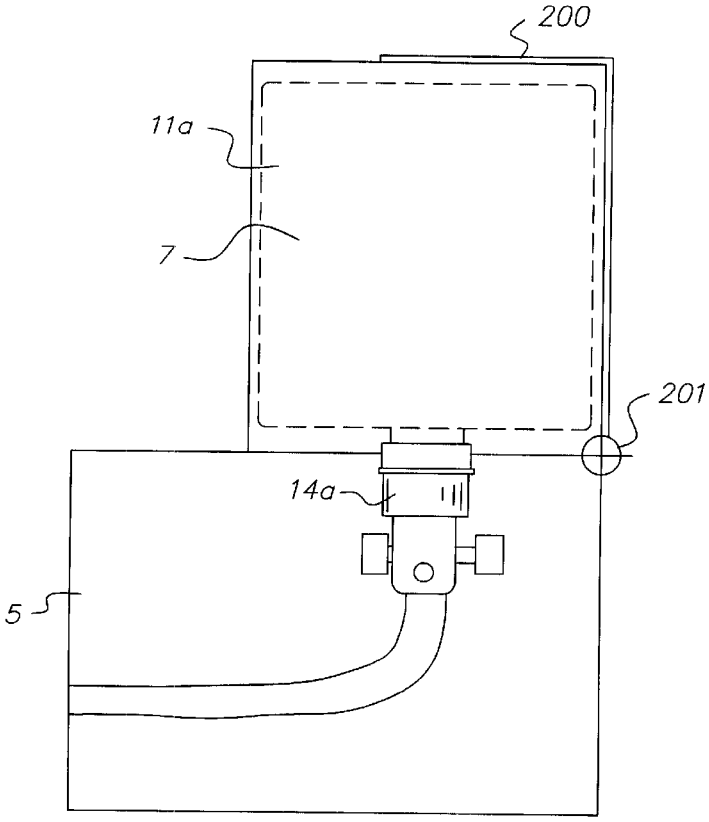

FIGS. 7A–7B illustrate a further feature of the present invention which focuses on the synergy between a supply cartridge in accordance with the present invention and an associated processor. More specifically, in a feature of the invention, and particularly when using a supply cartridge similar to the embodiments illustrated in FIGS. 1, 2, 3 and 4A–4B, a cartridge, for example, cartridge 7 can be provided on or attached to a rotatable or movable fixture member or support frame 200 (FIG. 7A) in a manner in which the valves (i.e. valve 14*a*) are in an upright position. Rotatable or movable support frame 200 is rotatably or movably hinged and/or mounted onto processor 5 at point 201 in a known manner. Once cartridge 7 is loaded onto support frame 200, and using supply chamber 11*a* as an example, valve 14a can be connected to, for example, a supply tubing 205 as shown. As a further option, it is recognized that the connections to the processor can be made after frame 200 is rotated to the position of FIG. 7B. It is further recognized that the remaining valves of the other chambers would also be connected to associated supply tubes. Thereafter, support frame 200 is rotated or moved about point 201 to an operating position as illustrated in FIG. 7B for supplying processing solution to processor 5 and collecting spent solution from the processor. In the position of FIG. 7B, cartridge 7 and valve 14*a* are inverted to facilitate the emptying of chamber 11*a*. Upon the emptying of each of the supply chambers, support frame or fixture member 200 is used to place cartridge 7 in an upright position by rotating or moving frame 200. This permits the removal and replacement of cartridge 7.

Figure 8A:
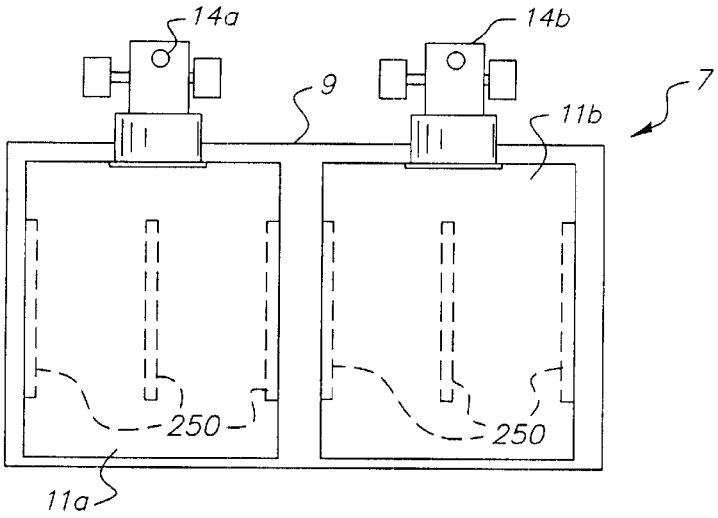
FIGS. 8A–8C illustrate a supply cartridge in accordance with the present invention having containers with baffles.
Figure 8B:
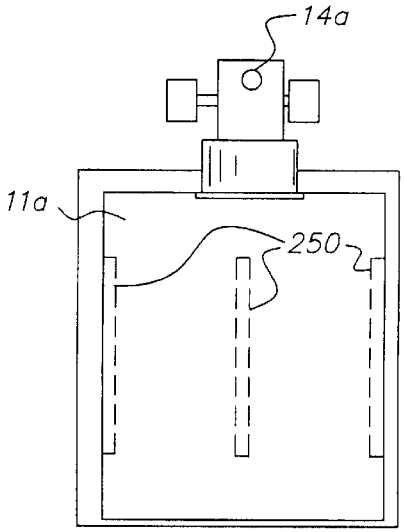
Figure 8C:
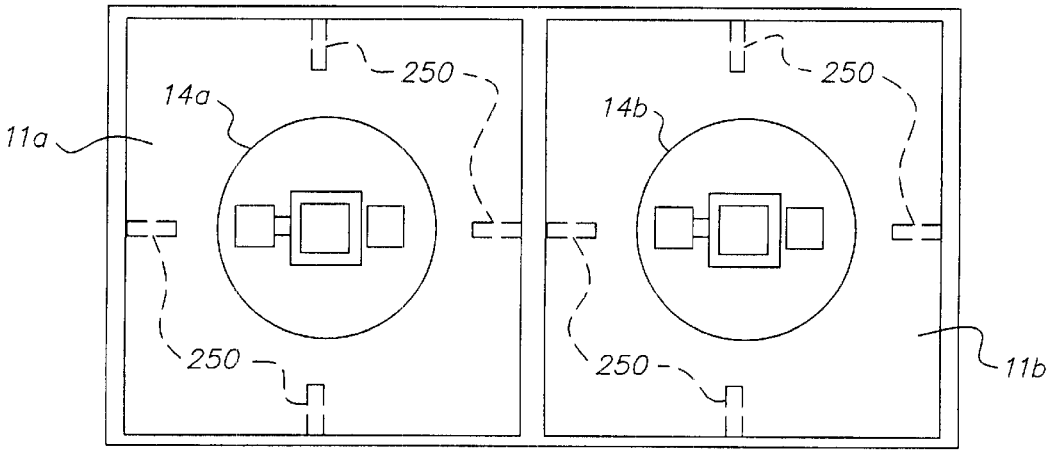

In a further feature of the invention as illustrated in FIGS. 8A–8C, each of the chambers of the described cartridges can be provided with "anti-slosh" baffles. More specifically, as shown in FIGS. 8A–8C, and using cartridge 7 as an example, chamber 11*a* can be provided with baffles 250 which minimize movement of solution within each of the chambers, especially when the chambers are being transported. As a further advantage, baffles 250 help to evenly distribute the weight of the chambers which facilitate lifting, handling and movement of the chambers.

In a still further feature of the invention, an absorbent can be inserted within the outer shell and around the chambers to prevent leakage from the cartridge or container.

The invention has been described in detail with particular reference to certain preferred embodiments thereof, but it will be understood that variations and modifications can be effected within the spirit and scope of the invention.

What is claimed is:

1. A photofinishing processing solution supply cartridge comprising:

at least one processing solution chamber for holding processing solution therein; and at least one spent solution chamber adapted to collect waste solution from a photofinishing system associated with said supply cartridge, said at least one spent solution chamber comprising a silver removal device that reduces an amount of leachable silver contained in the spent solution.

2. A supply cartridge according to claim 1, wherein said at least one spent solution chamber is removably attached to said supply cartridge.

3. A supply cartridge according to claim 1, wherein said processing solution chamber and said spent solution chamber are made of a flexible material to permit a displacement of volume within said supply cartridge as said at least one processing solution chamber empties and said at least one spent solution chamber fills with solution.

4. A photofinishing processing solution supply cartridge comprising:

at least one processing solution chamber for holding processing solution therein; and at least one spent solution chamber adapted to collect waste solution from a photofinishing system associated with said supply cartridge, said at least one spent solution chamber comprising a silver precipitating agent, said silver precipitating agent being adapted to react with the spent solution in said spent solution chamber to form a removable silver sludge in the spent solution chamber.

5. A supply cartridge according to claim 4, wherein said processing solution chamber and said spent solution chamber are made of a flexible material to permit a displacement of volume within said supply cartridge as said at least one processing solution chamber empties and said at least one spent solution chamber fills with solution.

6. A photofinishing processing solution supply cartridge comprising:

at least one processing solution chamber for holding processing solution therein and supplying processing solution to a photofinishing system which is fluidly associated with said supply cartridge; and a silver removal device for removing silver from spent processing solution of the photofinishing system associated with said supply cartridge to provide a substantially leachable silver-free spent solution.

* * * * *